US005626205A

United States Patent [19]

Martin

[11] Patent Number: 5,626,205

[45] Date of Patent: May 6, 1997

[54] PORTABLE WORK PLATFORM

[76] Inventor: Richard C. Martin, c/o New Ventures Product Development and Marketing, Inc., 137 Barre St., Montpelier, Vt. 05602

[21] Appl. No.: 342,108

[22] Filed: Nov. 18, 1994

[51] Int. Cl.[6] ..... E04G 1/00

[52] U.S. Cl. ..... 182/153; 182/225; 182/27

[58] Field of Search ..... 182/153, 181, 182/225, 222, 223, 152, 155, 27

[56] References Cited

U.S. PATENT DOCUMENTS

| | | |
|---|---|---|
| 513,012 | 1/1894 | Hall . |
| 896,286 | 8/1908 | Fatland . |
| 925,598 | 6/1909 | Rentfrow . |
| 2,012,592 | 8/1935 | Skiba . |
| 3,014,552 | 12/1961 | Fike . |
| 3,474,881 | 10/1969 | Green . |
| 3,613,831 | 10/1971 | Estep . |
| 3,724,592 | 4/1973 | Fleischer . |
| 3,739,876 | 6/1973 | Goldberg . |
| 4,284,171 | 7/1981 | Owen . |
| 4,493,392 | 1/1985 | Alimbau . |
| 4,699,246 | 10/1987 | Wang . |
| 5,332,062 | 7/1994 | Revere . |

*Primary Examiner*—Alvin C. Chin-Shue
*Attorney, Agent, or Firm*—Thompson Hine & Flory LLP

[57] ABSTRACT

A portable work platform for use in the construction trade which includes a pair of side rails interconnected by a plurality of crossbars and supported by pivotal legs connected to the rails. Disposable edge runners are attached along the upper surface of each rail to protect the rails and crossbars from damage caused by cutting and machining material on the platform surface. In addition, the cross-bars are of a square cross-section to enable workpieces and tools to be clamped to the bars for support.

19 Claims, 3 Drawing Sheets

PORTABLE WORK PLATFORM

BACKGROUND OF THE INVENTION

The present invention relates to a portable work surface for use in the construction trade, and more particularly, to a lightweight, portable work platform specially adapted to support a workpiece for carpentry.

In the construction trade, it is often necessary to transport tools and materials to a remote work site. At such remote work sites, it can be difficult to find a sturdy, level work surface for cutting and assembling material. While sawhorses have traditionally been used in conjunction with a sheet of material, such as a sheet of plywood, to form a work table, the resulting work table is usually unstable and easily damaged by cutting and sawing. Further, the plywood sheet can shift on the sawhorses during a cutting operation, creating a safety hazard. In addition to the above problems, transporting, assembling and disassembling the multiple sawhorses and plywood sheets at the work sites can be cumbersome.

While more sturdy, durable work surfaces, such as would normally be found in a workshop, are known, these work surfaces are usually large and heavy, thus making transportation to and assembly at a job site impracticable.

In view of the above problems, there is a need for a sturdy, lightweight work platform which can be easily transported to and assembled at a remote work site, and which is designed to facilitate various cutting and assembly tasks without damaging the structure of the platform or the workpiece.

SUMMARY OF THE INVENTION

Accordingly, the present invention is a portable, lightweight work platform which provides a sturdy support surface for sawing, cutting and assembling workpieces and for anchoring power tools. The work platform of the present invention includes a pair of substantially parallel side rails interconnected by a plurality of crossbars. Each of the crossbars has a square cross-section and a hollow interior to enable workpieces and tools to be securely clamped on the exterior and retained within the interior of the crossbars.

In addition, the side rails have channels shaped to receive disposable edge runners along the upper surface of the platform. The runners enable the workpiece to be supported without damaging the structure of the platform or the material. Preferably, the runners are attached to the rails by screws to enable them to be easily removed and replaced as they become worn. The platform also includes pivotal support legs which can be pivoted away from the rails to elevate the platform to a comfortable working level, or pivoted toward the rails to make the platform more compact to allow for easy handling and transportation of the platform.

Accordingly, it is an object of the present invention to provide a sturdy, lightweight, multi-purpose work platform which can be used for supporting a workpiece at a remote work site; a work platform which can be conveniently transported to and quickly set up at a work site; a work platform which enables large or heavy workpieces to be supported without damaging the surface of the workpiece; and a work platform which can be used to securely anchor and support tools, equipment and workpieces.

Other objects and advantages of the present invention will be apparent from the following description, the accompanying drawings and the appended claims.

DETAILED DESCRIPTION

Figure 1:
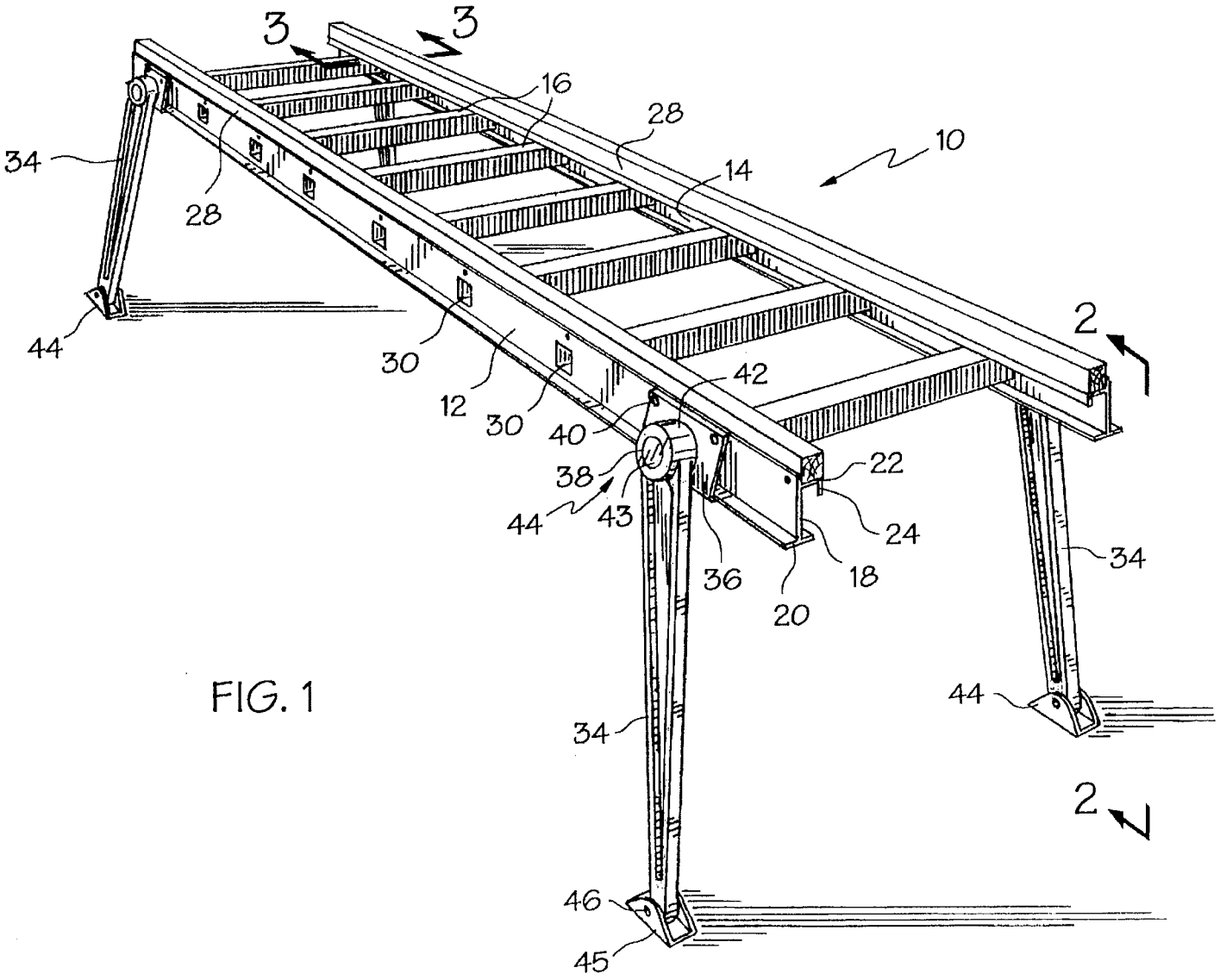
FIG. 1 is a perspective view of the work platform of the present invention.

As shown in FIG. 1, the present invention consists of a work platform, generally designated 10, having a pair of substantially parallel side rails 12, 14 connected by a plurality of substantially parallel spacers or crossbars 16. The rails 12, 14 are preferably comprised of extruded aluminum channel and are perpendicular to the crossbars 16. In the preferred embodiment, the platform 10 is approximately eight feet long and three feet wide.

Figure 2:
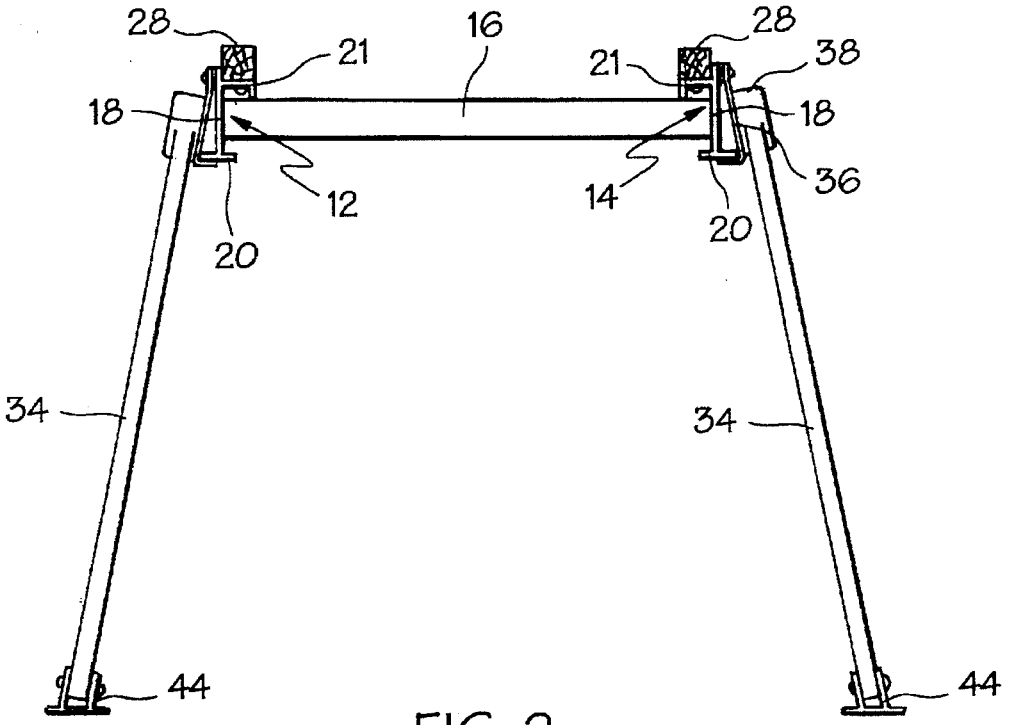
FIG. 2 is an end elevation of the work platform as seen along line 2—2 of FIG. 1.
Figure 3:
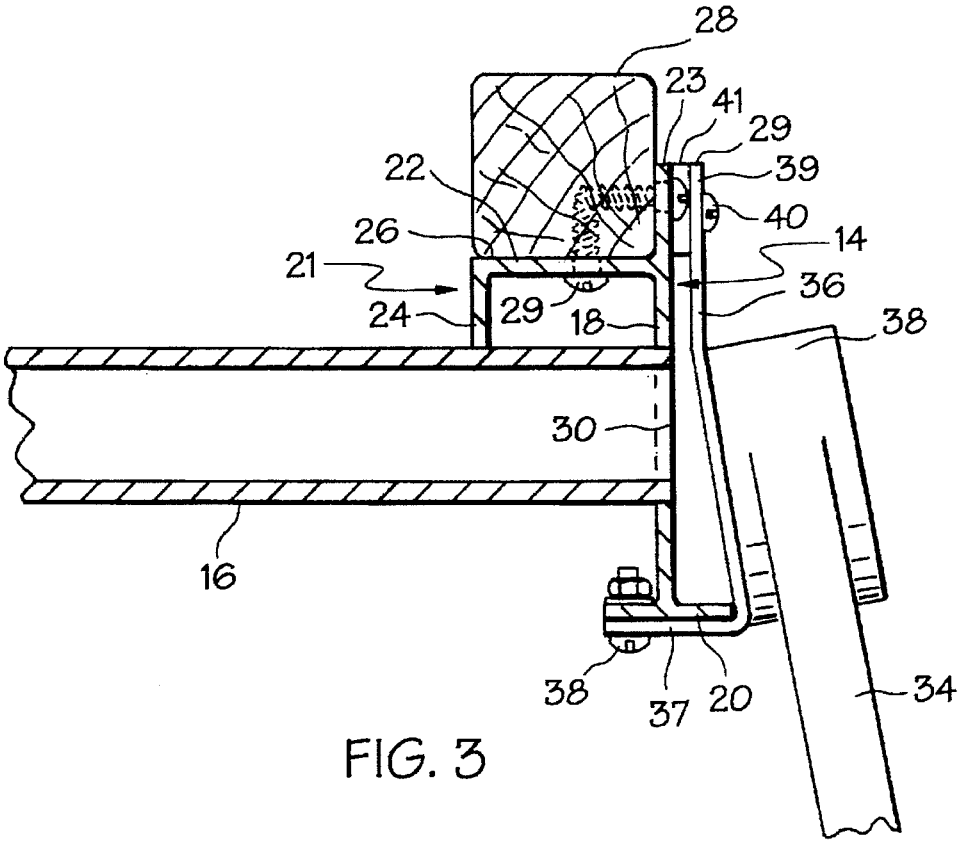
FIG. 3 is a detail partially in section taken along line 3—3.

As shown in greater detail in FIGS. 2–3, the rails 12, 14 each include a vertical web 18 having a horizontal flange 20 located at a lower end of the web, and a runner support 21 at an upper end of the web. As shown in greater detail in FIG. 3, the rail support 21 includes a rail base 22, a side wall 23 (which is an extension of web 18) and support strut 24. The structure of the support 21 for rail 12 is of identical construction, but is of reverse hand. The bases 22 and side walls 23 of support 21 form elongated seats 26 for receiving wooden runners 28, which are retained by screws 29 extending through the bases and side walls.

As shown in FIGS. 1 and 3, a plurality of openings 30 are spaced along the lengths of the rails 12, 14, and extend through the webs 18. The openings 30 are square in cross-section and are sized to receive the correspondingly shaped crossbars 16. The crossbars 16 preferably are spaced equidistantly substantially along the lengths of the rails 12, 14 and are brazed to and interconnect the rails at multiple points. The crossbars 16 preferably are comprised of extruded aluminum as are rails 12, 14.

In the preferred embodiment the interior of each crossbar 16 is hollow, and communicates with a pair of opposing openings 30 in the rails 12, 14 to form a series of hollow channels through the rails and crossbars along the length of the platform 10. Each of the channels is capable of holding tools or other equipment in the hollow channel. In addition, the flat faces of the crossbars are capable of being clamped to and holding stops or workpieces in an upright position relative to the platform.

As shown in FIG. 3, each of the crossbars 16 engage the undersides of the struts 24 to reinforce the connection between the crossbars 16 and rails 12, 14. In the preferred embodiment shown in FIG. 1, the invention includes eight crossbars. However, a greater or lesser number of crossbars can be utilized without departing from the scope of the invention.

As shown in FIGS. 1 and 3, the disposable edge runners 28 extend along the recesses 26 in the upper portion of the rails 12, 14. The runners 28 are preferably composed of a material, such as wood, which will not chip or dull cutting implements such as circular saws, or scratch or mar a workpiece placed on the platform. The runners 28 preferably have a rectangular or square cross-section, with at least two sides of the runner lying adjacent to the sides of the rail 12, 14. In the representative embodiment shown in the figures, the cross-sectional area of each runner 28 is approximately 2 inches by 2 inches.

Support legs 34 are attached adjacent to the ends of the rails 12, 14. Each of the legs 34 is pivotally attached to a bracket 36 which, in turn, is mounted on one of the rails 12, 14. The lower leg 37 of the bracket 36 lies against the underside of the flange 20 and is connected thereto by screw and nut combination 38. The upper leg 39 of the bracket 36 is attached to the side wall 23 by screw and nut combinations 40 and is spaced from the wall by washer 41. When attached, the brackets 36 project slightly outwardly from the sides of the rails 12, 14. The top portion of each leg 34 includes a cylindrical head 42 having an opening therein (not shown) which is shaped to receive a stud 43 attached to the bracket 36, to form a pivot joint (see FIG. 1). Each leg 34 also includes a detent spring (not shown) to facilitate the movement of the leg.

A foot 45 is attached at the lower end of each leg 34 by pivot attachments such as pivotal joint pins 46. Each foot 45 is pivotal with respect to its associated leg 34 to enable the foot to adjust to the ground terrain to provide a stable support base between the ground and the platform 10.

Figure 4:
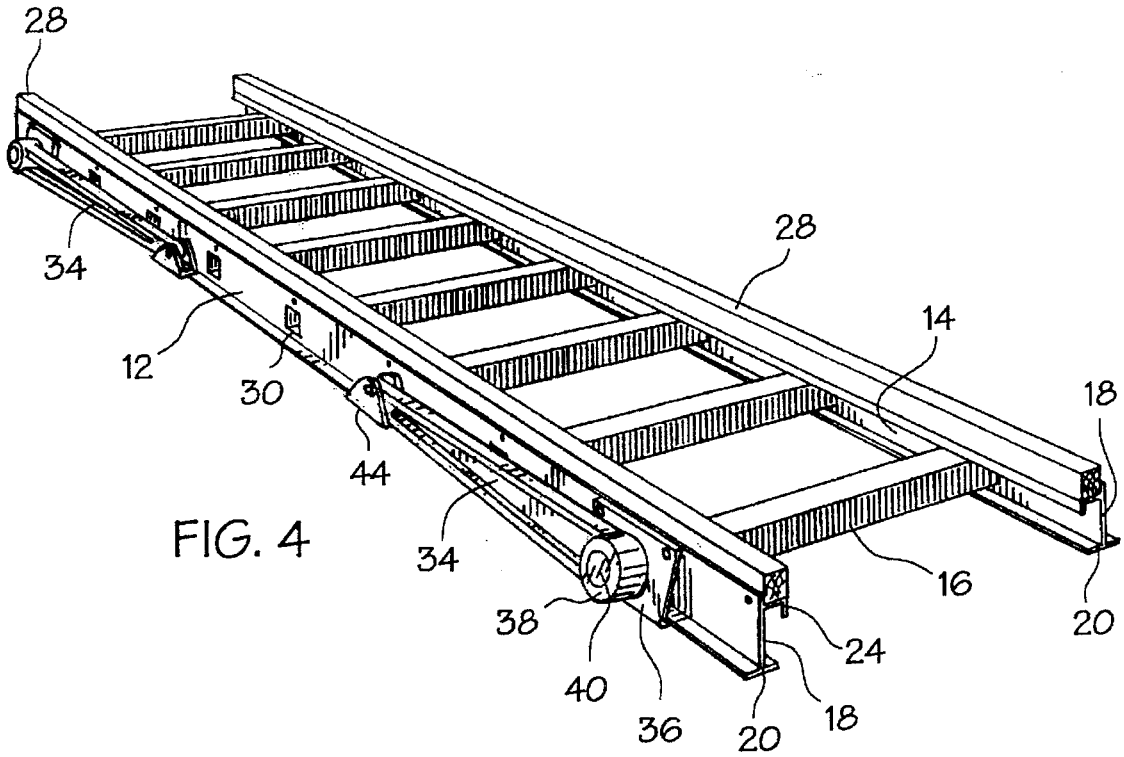
FIG. 4 is a perspective view of the platform of FIG. 1 depicting the support legs in a retracted position for transport.

Each of the legs 34 is independently adjustable at the pivot joint 42 to enable the legs to be separately extended perpendicular to the rails 12, 14. When extended, the legs 34 elevate the platform 10 to a comfortable working height. In an extended position, each of the legs 34 diverge slightly from the vertical plane of the rails 12, 14 to expand the area of support for the platform 10. In addition, each of the legs 34 is independently retractable into a position parallel with the rails 12, 14 for transport, such as shown in FIG. 4. When the legs 34 are in a retracted position, the platform 10 can be easily lifted and carried by either of the rails 12, 14.

Figure 5:
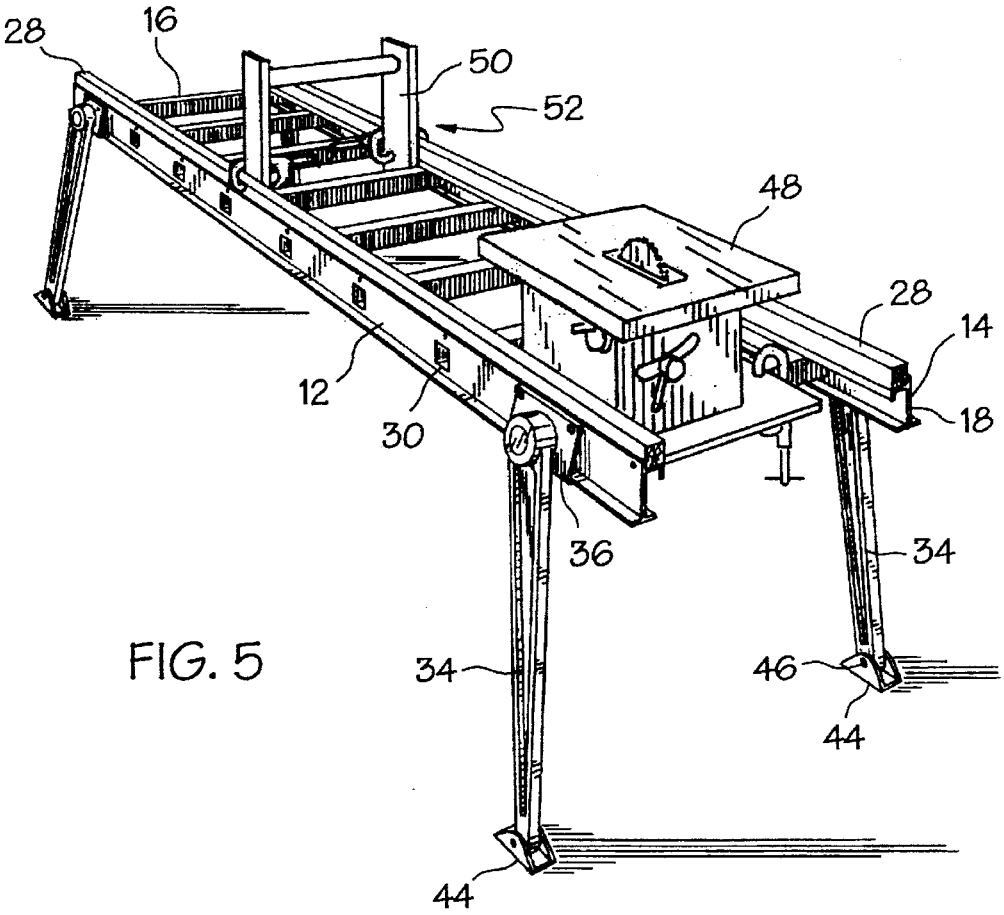
FIG. 5 is a perspective view of the platform of FIG. 1 depicting tools and workpieces clamped to the work platform.

As shown in FIG. 5, tools 48 and workpieces 50 can be clamped to the rails 12, 14 or crossbars 16 of the platform 10 in order to prevent their movement during use. Since the crossbars 16 are of a square cross-section, clamps can be more easily and securely anchored to the platform than would be possible with circular rungs or spacers. Further, clamps may be used in conjunction with the rails 12, 14, as shown at 52, in order to anchor wider objects to the platform 10.

The runners 28 of the present invention enable large sheets of material to be ripped with an electric saw without damaging the structure of the platform 10. Since the material rests on the runners 28, and not directly on the rails 12, 14 and crossbars 16, the saw blade will penetrate the runners, and not the more rigid structure of the platform. When the runners 28 become excessively cut or worn, they can be easily removed and replaced by disengaging the screw attachments along the rails.

While the apparatus herein described constitutes a preferred embodiment of the invention, it is to be understood that the invention is not limited to this precise form and that changes may be made therein without departing from the scope of the invention.

What is claimed is:

1. A work platform comprising:

a pair of substantially parallel rails;

a first crossbar positioned at a first end of said parallel rails and a second crossbar positioned at a second end of said parallel rail, said first and second crossbars extending perpendicular to said rail, for interconnecting said rails;

at least one additional crossbar intermediate said first and second crossbars for interconnecting said rails, said crossbars each have a rectangular cross-section and being shaped to accomodate a clamp, whereby a workpiece clamped thereto is held in a substantially upright position;

support means connected to said rails; and means removably attached to said rails for protecting a workpiece supported thereon and for protecting said rails, said protecting means being disposable and replaceable, wherein said rails futher comprise channels shaped to recieve said disposable protecting means.

2. The platform of claim 1 wherein said protecting means includes a pair of wooden runners.

3. The platform of claim 2 wherein said runners extend along an upper portion of said rails.

4. The platform of claim 3 wherein said runners are individually removably attached to said rails.

5. The platform of claim 1 wherein said crossbars have a square cross-section.

6. The platform of claim 5 wherein said support means comprises a plurality of legs and further comprising means for pivotally connecting said legs to said rails such that said legs are adjustable from a position parallel to said rails, to a position perpendicular to said rails.

7. The platform of claim 6 wherein each of said legs is independently pivotal with respect to said rails.

8. The platform of claim 7 wherein each of said legs includes a foot which is pivotal with respect to said leg.

9. The platform of claim 8 wherein said crossbars have a hollow interior.

10. The platform of claim 9 wherein said rails include a plurality of longitudinally spaced openings.

11. The platform of claim 10 wherein each of said openings coincides with one of said crossbars to form a series of continuous channels through said rails and crossbars.

12. The platform of claim 11 wherein said runners are attached to said rails by screws.

13. The platform of claim 12 wherein said legs diverge from said rails in an extended position.

14. The platform of claim 1 wherein said rails comprise a vertical web and a runner support at an upper end of said web, such that said protecting means is mounted above said runner support and said crossbars are mounted under said runner support.

15. A portable work platform comprising:

a pair of parallel, metallic side rails having a plurality of longitudinally spaced openings therethrough;

a plurality of hollow crossbars having rectangular cross-section interconnecting said rails, said hollow crossbars aligning with said openings in said side rails;

a plurality of support legs connected to said rails, said legs being pivotal with respect to said rails for raising and lowering said platform;

a plurality of removable, disposable runners; and means for removably attaching said runners to an upper surface of said rails, wherein said rails futher comprise channels shaped to receive said disposable wooden runners.

16. The platform of claim 15 wherein said runners are attached to said rails by screws.

17. The platform of claim 16 wherein said crossbars are shaped to accommodate clamps for clamping workpieces to said platform.

18. The platform of claim 17 wherein said crossbars have a square cross-section.

19. The platform of claim 15 wherein said rails comprise a vertical web and a runner support at an upper end of said web, such that said wooden runner is mounted above said runner support and said crossbars are mounted under said runner support.

* * * * *